United States Patent [19]

Strozier

[11] Patent Number: 4,753,104

[45] Date of Patent: Jun. 28, 1988

[54] DENT REMOVING TOOL AND METHOD

[75] Inventor: Robert E. Strozier, Atlanta, Ga.

[73] Assignee: Body Buddy, Inc., Atlanta, Ga.

[21] Appl. No.: 926,512

[22] Filed: Nov. 3, 1986

[51] Int. Cl.[4] ..... B21D 01/06

[52] U.S. Cl. ..... 72/457; 72/705; 294/64.2

[58] Field of Search ..... 72/705, 457; 294/64.1, 294/64.2

[56] References Cited

U.S. PATENT DOCUMENTS

| | | | |
|---|---|---|---|
| 2,771,933 | 11/1956 | Edwards | 72/705 |
| 3,030,837 | 4/1962 | Chartier | 81/15 |
| 3,570,289 | 3/1971 | Smyers | 72/479 |
| 3,584,836 | 6/1971 | Brubaker | 72/705 |
| 3,712,106 | 1/1973 | Holsapple et al. | 72/705 |
| 3,744,291 | 7/1973 | Hagerty et al. | 72/705 |
| 3,779,057 | 12/1973 | Sonnenberg | 72/705 |

FOREIGN PATENT DOCUMENTS

| | | | |
|---|---|---|---|
| 954,315 | 4/1964 | United Kingdom | 294/64.1 |

*Primary Examiner*—Lowell A. Larson
*Attorney, Agent, or Firm*—Kilpatrick & Cody

[57] ABSTRACT

A sheet metal working tool particularly adapted for automobile body repair comprising a slide hammer assembly attached to a suction cup from which air is drawn through the assembly. One embodiment utilizes a separate vacuum pump or ejector connected to the assembly through a vacuum hose. Another embodiment incorporates a compressed air-operated vacuum ejector functioning on the venturi principle into a stop on the end of the slide hammer assembly opposite the suction cup.

14 Claims, 4 Drawing Sheets

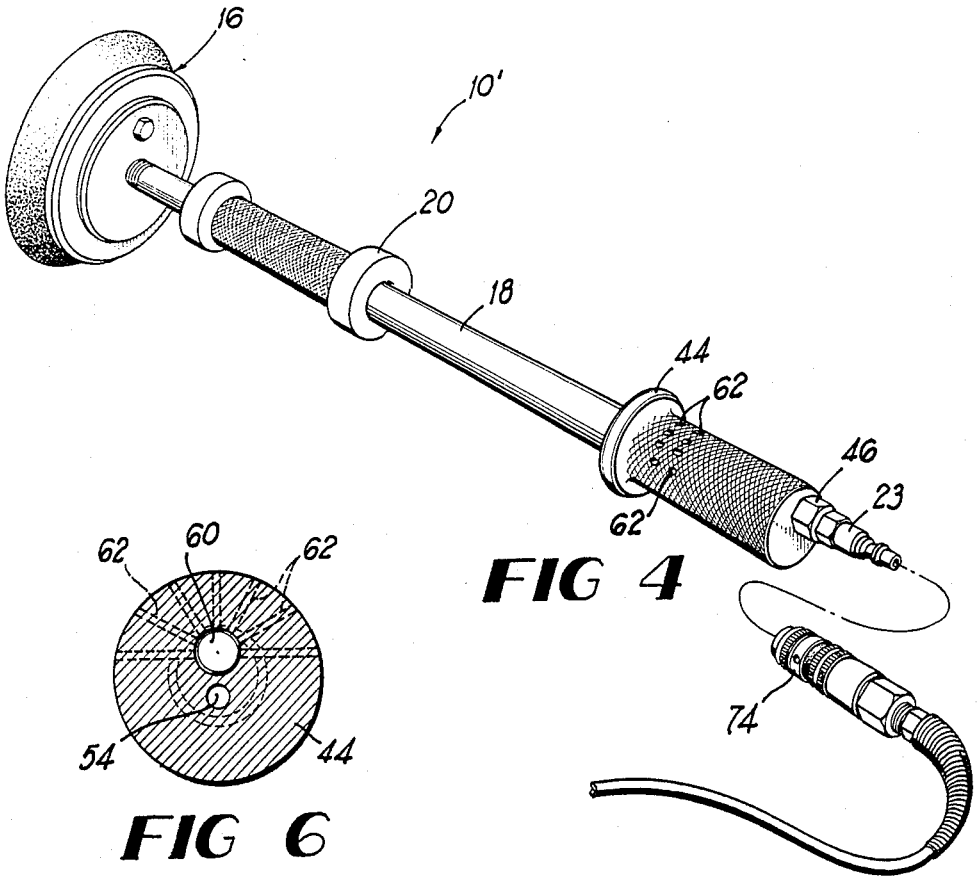
FIG 4
FIG 6
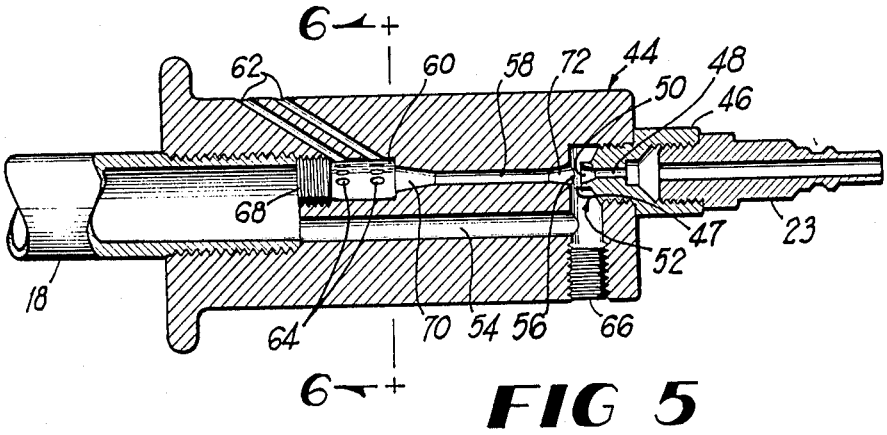
FIG 5

DENT REMOVING TOOL AND METHOD

BACKGROUND OF THE INVENTION

This invention relates to tools used for restoring the original contour of sheet metal, particularly that contained in the bodies of vehicles such as automobiles, trucks, aircraft, trailers, boats and the like.

Dent-removing hand tools are well-known in the prior art because it is frequently necessary to remove concave dents from panels and fenders of motor vehicles. This is sometimes possible by hammering from the rear or by filling the dents with a material such as metal or plastic which is later leveled to produce a smooth surface.

It is frequently difficult, however, to obtain access to the rear of dented panels because door panels, fenders and other structures are often enclosed or the rear is otherwise obstructed. Repair techniques involving fillers are time-consuming and expensive.

Consequently, a number of conventional tools have been developed to remove concave dents. Perhaps best known among these tools is a slide hammer or "slap" hammer with a screw-end. The screw-end is first embedded in a hole in the panel, and pulling force is then applied by rapidly sliding a weight or hammer along a rod away from the screw and against a stop on the end of the rod opposite the screw. Typical of such prior slide hammers are the ones described in U.S. Pat. Nos. 3,030,837 and 3,570,289. Such devices damage the panel being repaired by leaving a screw hole in it. Consequently, it has previously been suggested that a suction cup, as illustrated in FIG. 3 of U.S. Pat. No. 3,570,289, be substituted for the screw in a slide hammer dent removing tool.

By contrast, U.S. Pat. No. 3,584,836 illustrates a dent remover which uses a suction cup having a port through which a vacuum is drawn. The cup is pulled by a chain attached to the middle of the cup and to a hydraulicly actuated stanchion. While U.S. Pat. No. 3,584,836 offers some advantages by utilizing a suction cup from which air is drawn by external means, it is a large, expensive, cumbersome structure which is not well adapted to removal of dents on all vehicle-body orientations or to convenient, speedy use.

SUMMARY OF THE INVENTION

The present invention offers the convenience and versatility of a highly portable slide hammer dent-removing tool which utilizes a suction cup and vacuum arrangement to contact the panel being worked rather than a screw, thereby avoiding further damage to the panel which occurs when a screw-end type dent remover is used. The tool includes a suction cup mounted on the end of a sturdy tube or pipe along which a slide hammer travels to contact a stop at the end of the tube opposite the suction cup. A partial vacuum is drawn within the suction cup through the tube. In one configuration, the vacuum is drawn by a remote vacuum pump or vacuum ejector through a flexible tube attached between the pump and the end of the tool opposite the suction cup. In another configuration, a vacuum pump is mounted directly on the stop on the end of the tube. In yet another configuration, the vacuum pump is an integral part of the stop against which the slide hammer acts. Various valve arrangements permit quick attachment and removal of the suction cup from the workpiece during operation.

The same general structure can also be used as an efficient tool for clearing clogged plumbing in much the same way a conventional "plumber's friend" or plunger is used.

Accordingly, it is an object of the present invention to provide an inexpensive, highly portable, very effective, vehicle body-working tool which can remove concave dents from sheet metal panels without further damaging such panels.

It is an object of the present invention to provide such a tool which uses compressed air as a vacuum "power source" since compressed air is readily available in automobile body shops.

It is a further object of the present invention to provide such a tool which is easily operated and extremely durable, since the typical automobile body shop environment in which such tools are used and stored is one in which tools receive very rough treatment.

Other objects and advantages of the present invention will become apparent by reference to the accompanying drawings and the following description and claims.

BRIEF DESCRIPTION OF THE DRAWINGS

FIG. 4 is a perspective view of a second embodiment of the present invention having a vacuum ejector incorporated in the slide hammer stop.

FIG. 5 is a side elevation view, in section, of the vacuum ejector portion of the embodiment of the present invention shown in FIG. 4.

FIG. 6 is a section taken along lines 6—6 in FIG. 5.

DETAILED DESCRIPTION OF THE DRAWINGS

Figure 1:
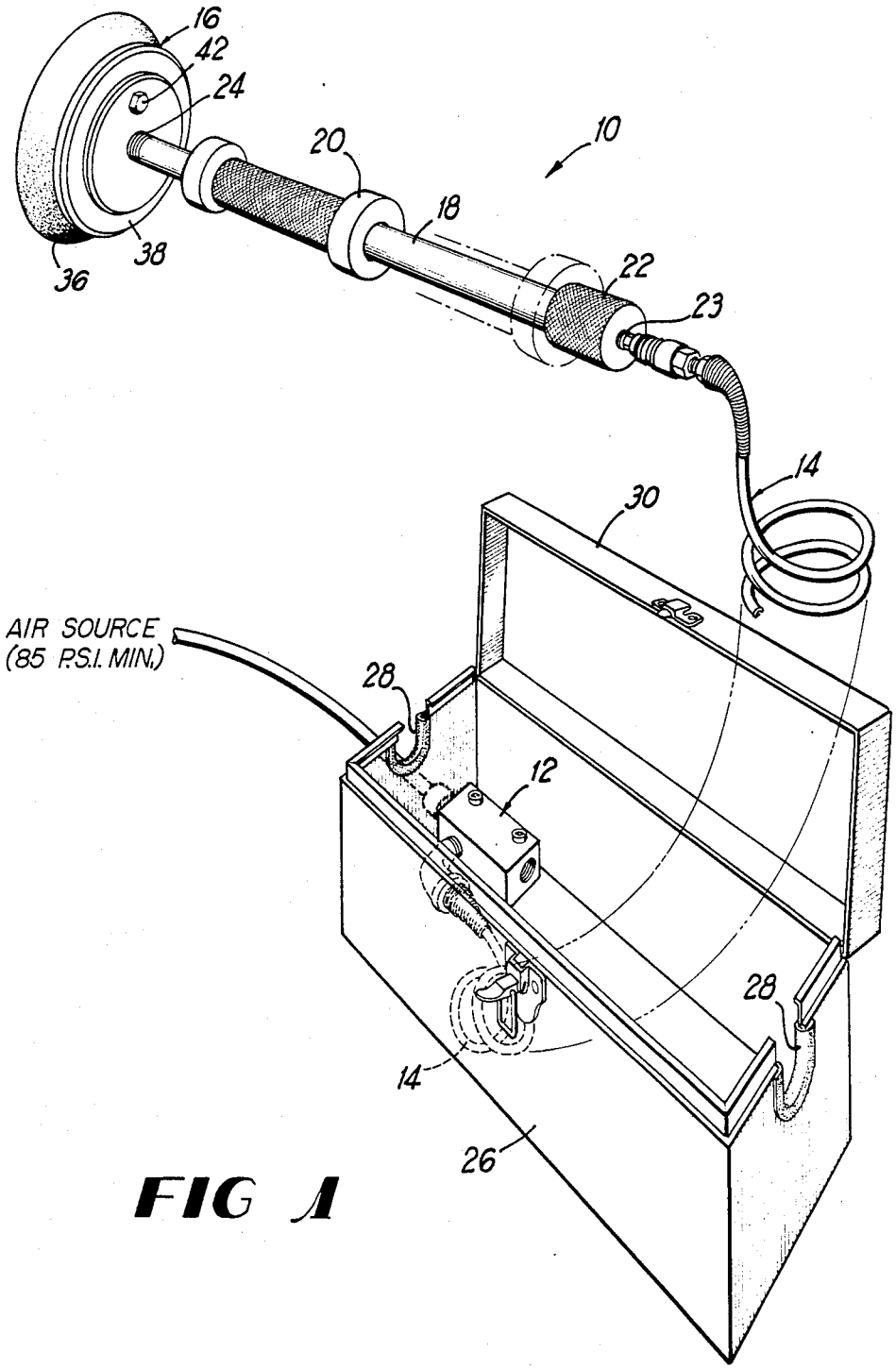
FIG. 1 is a perspective view of a first embodiment of the present invention showing the slide hammer dent-removing tool of the present invention and a tool chest and vacuum ejector assembly in which it may be stored.

The principal parts of the first embodiment of the present invention illustrated in FIG. 1 are a slide hammer assembly 10 and a vacuum pump or ejector 12 which is connected to assembly 10 by a vacuum hose 14. Slide hammer assembly 10, also illustrated in FIG. 2, comprises generally a suction cup 16 attached to one end of a slide tube 18 along which a hammer 20 slides in order to impact a stop 22 made of impact steel, aluminum or other suitable material and attached to the other end of the slide tube 18. Stop 22 carries an air fitting 23 to which one end of hose 14 attaches, thereby permitting communication between hose 14 and opening 24 in suction cup 16 through slide tube 18, thus permitting fluid communication between the working side of suction cup 16 and hose 14. The opposite end of hose 14 is attached to any device for drawing a vacuum, such as the vacuum ejector 12 illustrated in FIG. 1.

As one skilled in the art will readily recognize, vacuum ejector 12, which is operated by the application of an external compressed air source, may alternatively be a gasoline or electrically powered vacuum pump or any other suitable means for drawing a vacuum through hose 14, slide tube 18 and suction cup 16.

A suitable vacuum ejector 12 is the model CV05 vacuum ejector sold by the Eject-toor Division of Gast Manufacturing Corporation and distributed by Convum International Corp., 1601 West Redondo Beach Boulevard, Gardena, Calif. 90247. Operation of this vacuum ejector 12 by application of an external air source supplying 85 pounds per square inch pressure at a volume of 3.5 cubic feet per minute has been found to provide entirely satisfactory operation.

Vacuum ejector 12 is permanently mounted in a tool box 26 which has cradles 28 to receive slide tube 18 for storage of the slide hammer assembly 10. During operation, hose 14 may be positioned in one of the cradles 28 so that the top 30 of tool box 26 may be closed, thereby providing a means for muffling the noise emitted by vacuum ejector 12. When the tool is not in use, hose 14 may be detached from slide hammer assembly 10 and stored in the bottom of tool box 26, slide hammer assembly 10 may be placed in cradles 28, and the top 30 of tool box 26 may be closed.

Figure 2:
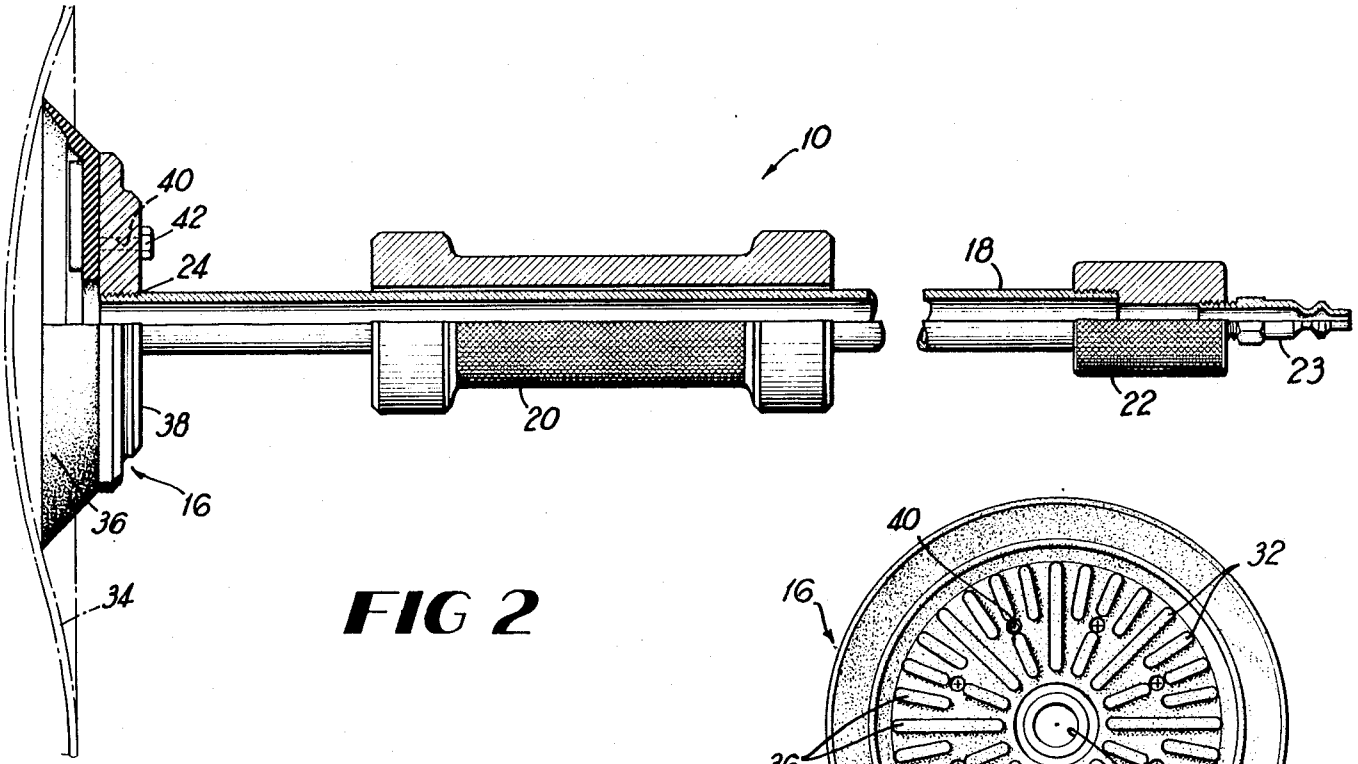
FIG. 2 is a side elevation view, partially in section, of the suction cup, tube, slide hammer, and stop portions of the embodiment of the invention shown in FIG. 1.
Figure 3:
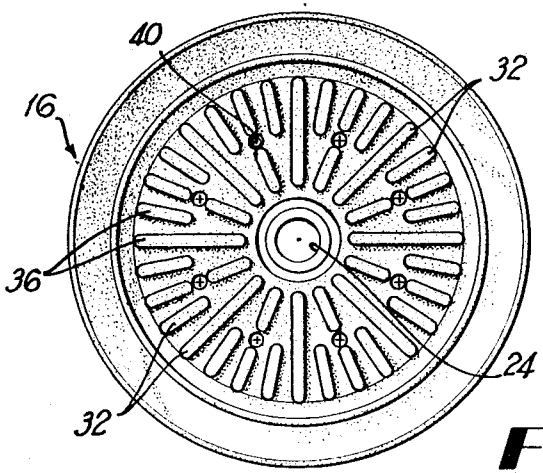
FIG. 3 is an elevation view of the side of the suction cup of the present invention which contacts the dented panel to be worked.

As may be seen by reference to FIG. 3, suction cup 16 has a series of upstanding knobs 32 which provide rigidity to the cup 16 and act as stops against which a panel 34 being repaired (as shown in FIG. 2) will rest in order to avoid forming a concavity in that panel. Suction cup 16 comprises a resilient portion 36 and a rigid backing plate 38, the center of which plate 38 is threaded and thus engages one threaded end of slide tube 18. A release port 40 communicates between the outside and inside of the suction cup 16 and is closed by a plug 42.

In alternative configurations, the means for drawing a vacuum could be connected to this release port 40. Port 40 can also be opened to "release" a vacuum drawn through slide tube 18 by permitting air to enter cup 16. Alternatively, compressed air may be selectively injected into suction cup 16 through release port 40 or slide tube 18 in order to achieve quick release of cup 16 from the material 34 being worked. For instance, insertion of a valve between cup 16 and vacuum ejector 12 or 44 (described below) which selects either (1) vacuum or atmospheric pressure or (2) vacuum or compressed air will permit rapid repeated release and attachment of cup 16 to the material 34 being worked. Other means of controlling the air pressure level within cup 16 are discussed below.

A suction cup 16 suitable for use in practicing the present invention is the PIAB model F150 available from Air Tech, P.O. Box 2085, Stone Mountain, Ga. 30086.

A second embodiment of the present invention is illustrated in FIGS. 4, 5 and 6. This embodiment is generally similar to the ones illustrated in FIGS. 1 and 2, except that a combination vacuum ejector and stop 44 has been substituted for the stop 22 in slide hammer assembly 10 illustrated in FIGS. 1 and 2.

FIG. 4 illustrates a slide hammer assembly 10' comprising a suction cup 16, a slide tube 18, a slide hammer 20 and a vacuum ejector/stop 44.

As will be readily appreciated by one skilled in the art, the slide hammer assembly 10' illustrated in FIG. 4 provides an extremely compact, sturdy and easily stored and utilized dent-removing tool.

As an alternative to utilization of the vacuum ejector/stop 44 illustrated in FIG. 4, vacuum ejector 12 illustrated in FIG. 1 may be mounted directly on stop 22 (illustrated in FIGS. 1 and 2) in place of air fitting 23. While such a configuration achieves some of the advantages of the slide hammer assembly 10' illustrated in FIG. 4, some risk of damage to vacuum ejector 12 is presented in that configuration, particularly in view of the relatively weak connection between stop 22 and vacuum ejector 12.

FIGS. 4, 5 and 6 illustrate an appropriate structure for vacuum ejector/stop 44, although it will be readily appreciated by one skilled in the art that numerous alternative configurations may be utilized in order to incorporate a vacuum ejector operating on the venturi principle into the stop 44.

Compressed air is blown through air fitting 23 into nozzle 46. Nozzle 46 includes a nozzle passage 48 which ends in a flared opening 50 positioned in a diffusion chamber 52 which communicates through a vacuum passage 54 with the interior of slide tube 18. Directly opposite flaired opening 50 of nozzle 46 is an opening 56 which communicates via passage 58 with exhaust chamber 60. Exhaust chamber 60 in turn communicates by means of a radial series of exhaust openings 62 with the exterior of vacuum ejector/stop 44. Exhaust chamber 60 may be filled with an open cell plastic foam 64, such as the type used in bed pillows or plastic sponges, to provide some muffling of noise from vacuum ejector/-stop 44. As will be appreciated by one familiar with the venturi principle, a partial vacuum is established in diffusion chamber 52 and, via vacuum passage 54 and slide tube 18, within suction cup 16.

Vacuum ejector/stop 44 may be machined from impact steel, aluminum or other appropriate materials, as will be readily appreciated by any skilled machinist, by boring and tapping an appropriate series of holes.

For instance, diffusion chamber 52 is formed by boring an appropriate opening and then partially plugging it with plug 66. Similarly, exhaust chamber 60 may likewise be formed by boring and partially plugging an opening with plug 68. Other openings are simply bored and flared or threaded as required and as will be readily appreciated by any machinist.

Although vacuum ejector/stop 44 may be successfully produced utilizing a number of different configurations, the configuration shown in FIGS. 4, 5 and 6 was found to be successful with the following dimensions: Passage 58 is 1.488 inches long and 0.14 inches in diameter at its narrow portion. The passage 58 taper 70 into exhaust chamber 60 is 0.310 inches long and 0.186 inches in diameter at the exhaust chamber 60. The passage 58 taper 72 into diffusion chamber 52 is 0.190 inches long and 0.159 inches in diameter at the diffusion chamber 52. Diffusion chamber 52 is 0.302 inches in diameter and exhaust chamber 60 is 0.386 inches in diameter. The end 47 of nozzle 46 is positioned 0.082 inches from opening 56 at the flared end of taper 72 of passage 58. Tapered passage 50 of nozzle 46 is 0.169 inches long and tapers from 0.110 to 0.060 inches. Nozzle passage 48 is 0.060 inches in diameter adjacent to tapered passage 50 and along a length of 0.164 inches and then opens to 0.200 inches in diameter along a length 0.24 inches. Nozzle 46 receives a conventional quick connector air fitting 23.

As is readily apparent from the description above, attachment of suction cup 16 to a panel 34 is accomplished by establishing a partial vacuum within suction cup 16, and it is removed by restoring normal air pressure within suction cup 16 or increasing the pressure there to an above normal level. This may be accomplished in the embodiment of the present invention illustrated in FIG. 1, among other ways, by supplying and removing the air source to vacuum ejector 12 or attaching and then detaching hose 14 from air coupling 24. Similarly, the air source to assembly 10' shown in FIG. 4 may be alternatively supplied and removed. This may be conveniently accomplished by use of a combination valve and coupling 74 which may be a Dynaquip DC-O available from Dynaquip Controls, 1645 Mfg. Drive, Fenton, Mo. 63026.

Figure 7:
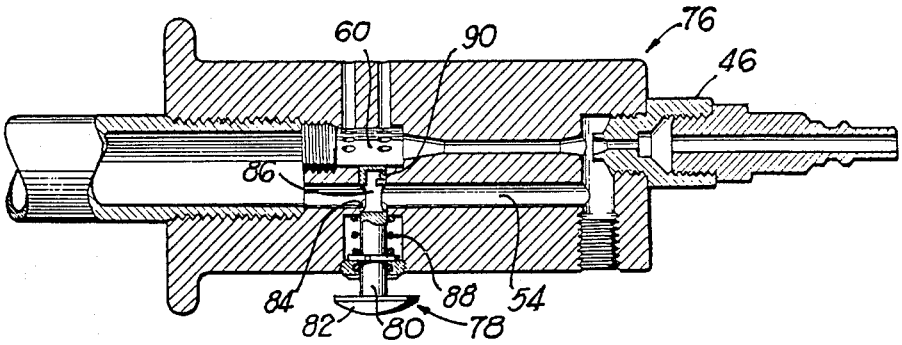
FIG. 7 is a side elevation, in section, of a vacuum ejector/stop similar to the one illustrated in FIG. 5 but including a control.
Figure 8:
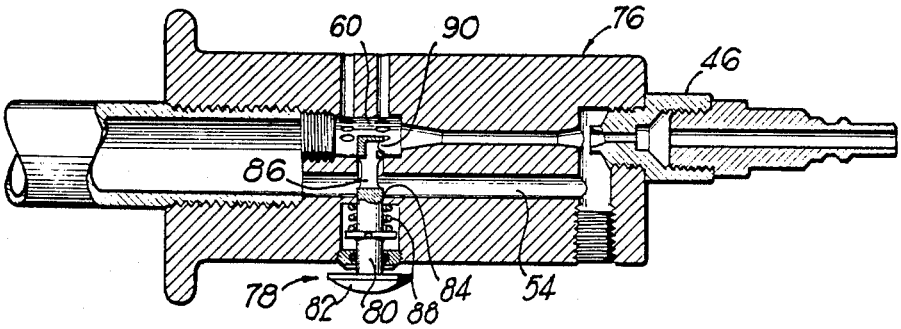
FIG. 8 is identical to FIG. 7 except that the control is shown in its actuated position.
Figure 9:
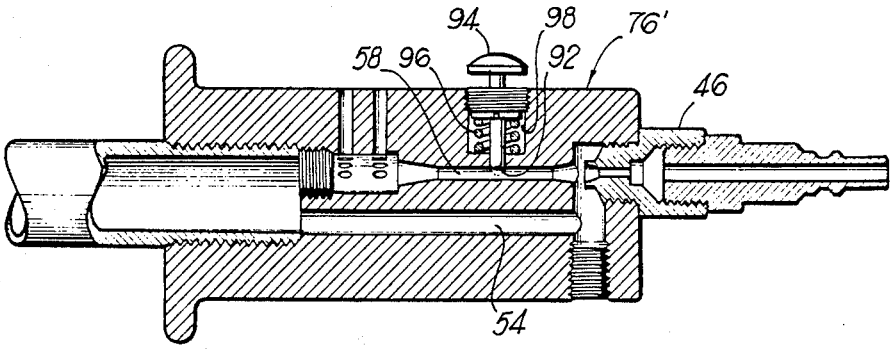
FIG. 9 is a side elevation view, in section, of a vacuum ejector/stop similar to FIG. 5 including an alternative control.

Alternative means of selectively controlling the air pressure within suction cup 16 to permit rapid attachment and removal of the cup 16 from a work piece are illustrated in FIGS. 7, 8 and 9. Use of such an easily-operated control will permit the operator to "walk" the suction cup along a panel or workpiece in order to work several spots on the panel in quick succession.

FIGS. 7 and 8 illustrate a combination vacuum ejector/stop 76 generally similar to vacuum ejector/stop 44 but having a push-button air control 78. Air control 78 includes a pin 80 operated by a button 82. Pin 80 travels in a bore 84 in ejector/stop 76, which bore intersects vacuum passage 54 and exhaust chamber 60. Pin 80 has a transverse opening 86, and a spring 88 urges pin 80 and button 82 out of ejector/stop 76 so that transverse opening 86 is normally coaxial with vacuum passage 54, thereby permitting establishment of a partial vacuum in suction cup 16 when air is supplied through nozzle 46 as described above. When removal of suction cup 16 from the work piece is desired, button 82 may be depressed, as is illustrated in FIG. 8. Depression of button 82 forces a portion of pin 80 into exhaust chamber 60. A passage 90 in pin 80 communicates between exhaust chamber 60 and transverse opening 86 in pin 80 when pin 80 is depressed, thereby establishing fluid communication between exhaust chamber 60 and vacuum passage 54 and consequently defeating operation of the venturi principle in vacuum ejector/stop 44. Such interruption of operation of the venturi principle in ejector/stop 44 results in normal or above normal air pressure within suction cup 16.

FIG. 9 illustrates an ejector/stop 76' having an alternative control means comprising a spring 96 loaded pin 92 actuated by a button 94. Pin 92 travels in a bore 98 in vacuum ejector/stop 44 which intersects passage 58.

As will be readily apparent by reference to FIG. 9, pressing button 94 will cause pin 92 to travel into passage 58, thereby occluding passage 58 and defeating operation of the vacuum ejector 44. Air entering vacuum ejector/stop 44 through nozzle 46 will also be diverted into vacuum passage 54, thus increasing air pressure within suction cup 16 above normal pressure.

In all embodiments of the present invention, a substantial reduction of air pressure is established on the slide hammer assembly 10 or 10' side of a panel being worked by the combination of (1) the reduced pressure within suction cup 16 resulting from withdrawal of air from the cup 16 and (2) force applied to draw suction cup 16 in the direction away from the panel by vigorously sliding hammer 20 against vacuum ejector/stop 44 or stop 22, thereby distorting cup 16 and thus increasing the volume of the air inside of cup 16. Such reduction of air pressure on the tool side of the panel will permit ambient air pressure on the opposite side of the panel to push the panel in the direction of the tool, thereby returning a dented panel to its original contour as the ambient air pressure urges the panel to "follow" the direction of movement of the suction cup 16.

The preceding description and drawings of the present invention are provided for purposes of explanation and illustration. It will be apparent to those skilled in the relevant art that modifications and changes may be made to the invention as described without departing from its scope and spirit.

I claim:

1. A sheet material working tool, comprising a slide tube with a suction cup on one end and a stop on the other end, a slide hammer slidably mounted to slide along the tube and impact the stop and a means for reducing the air pressure within the suction cup which means communicates with the suction cup through the slide tube.

2. A sheet material working tool in accordance with claim 1, wherein said means for reducing the air pressure is a vacuum ejector.

3. A sheet material working tool in accordance with claim 2, wherein said means for reducing the air pressure within the suction cup comprises a vacuum ejector mounted on the stop.

4. A sheet material working tool in accordance with claim 2, wherein said means for reducing the air pressure within the suction cup also comprises said stop.

5. A sheet material working tool in accordance with claim 4, wherein said suction cup includes knobs inside the cup.

6. A sheet material working tool, comprising a slide tube with a suction cup on one end, a combination vacuum ejector and stop mounted on the other end of the slide tube and communicating with the suction cup through the slide tube and a slide hammer mounted to slide along the tube and impact the stop.

7. A sheet material working tool in accordance with claim 6, further comprising a means for controlling said vacuum ejector.

8. A sheet material working tool, comprising a slide tube with a suction cup on one end, a stop mounted on the other end of the slide tube and a vacuum ejector having a control communicating with the suction cup through the slide tube to reduce the air pressure within the slide tube and suction cup.

9. A sheet material working tool in accordance with claim 8, wherein said suction cup includes knobs inside the cup.

10. A sheet material working tool, comprising a slide tube with a suction cup mounted on one end to provide fluid communication between the tube and the inside of the cup, a stop mounted on the other end of the tube, a hammer slidably mounted on the tube to impact the stop, a means for reducing atmospheric pressure and a hose communicating between the pressure reducing means and the end of the slide tube on which the stop is mounted.

11. A sheet material working tool in accordance with claim 10, further comprising a box within which said means for reducing the air pressure is mounted to provide muffling of noise generated by operation of the pressure reducing means and to store the hose and suction cup, slide tube, hammer and stop assembly when the tool is not in use.

12. A sheet material working tool in accordance with claim 11, wherein said suction cup includes knobs inside the cup.

13. A sheet material working tool comprising a slide tube with a suction cup on one end, a stop and a vacuum ejector mounted on the other end of the slide tube, which vacuum ejector communicates with the suction cup through the slide tube, and a slide hammer mounted to slide along the tube and impact the stop.

14. A sheet material working tool in accordance with claim 13, wherein said suction cup includes knobs inside the cup.

* * * * *